US011069298B2

(12) United States Patent
Xuan et al.

(10) Patent No.: US 11,069,298 B2
(45) Date of Patent: Jul. 20, 2021

(54) DRIVING CIRCUIT, DISPLAY PANEL, DRIVING METHOD AND DISPLAY DEVICE

(71) Applicant: BOE Technology Group Co., Ltd., Beijing (CN)

(72) Inventors: Minghua Xuan, Beijing (CN); Li Xiao, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/815,408

(22) Filed: Mar. 11, 2020

(65) Prior Publication Data

US 2021/0118366 A1 Apr. 22, 2021

(30) Foreign Application Priority Data

Oct. 21, 2019 (CN) ..... 201911000241.5

(51) Int. Cl.
*G09G 3/3233* (2016.01)
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0452* (2013.01); *G09G 2300/0842* (2013.01); *G09G 2310/08* (2013.01); *G09G 2320/0233* (2013.01)

(58) Field of Classification Search
CPC .. G09G 3/3208; G09G 3/3258; G09G 3/3233; G09G 3/3266; G09G 2300/0452; G09G 2300/0804; G09G 2300/231; G09G 2300/061; G09G 2310/08; G09G 2320/0233; G09G 2300/0842; H01L 27/3213
See application file for complete search history.

(56) References Cited

U.S. PATENT DOCUMENTS

2005/0110723 A1* 5/2005 Shin ..... G09G 3/3233 345/76
2005/0225574 A1 10/2005 Brown Elliott et al.
2006/0087478 A1 4/2006 Eom
2009/0309821 A1 12/2009 Tanno
(Continued)

FOREIGN PATENT DOCUMENTS

CN 1722193 A 1/2006
CN 105528997 A 4/2016
(Continued)

OTHER PUBLICATIONS

Office Action for corresponding Chinese Application 2019110002041.5 dated Aug. 4, 2020.

*Primary Examiner* — Michael J Eurice
(74) *Attorney, Agent, or Firm* — Arent Fox LLP; Michael Fainberg

(57) ABSTRACT

A driving circuit, a display panel, a driving method and a display device. The driving circuit includes a pixel circuit and a plurality of light emitting devices; the pixel circuit includes: a data control circuit, a light emitting control circuit and a driving transistor, wherein at least two light emitting devices share the same pixel circuit, and thus, the light emitting devices is driven by the pixel circuit to emit light; and due to the effect of the light emitting control circuit, the light emitting devices can be controlled to emit light in a time-sharing manner.

13 Claims, 7 Drawing Sheets

(56) References Cited

U.S. PATENT DOCUMENTS

| | | | | |
|---|---|---|---|---|
| 2016/0372043 | A1* | 12/2016 | Yamanaka | G09G 3/3266 |
| 2017/0229056 | A1 | 8/2017 | Li et al. | |
| 2019/0140029 | A1* | 5/2019 | Kim | H01L 27/3276 |
| 2020/0105196 | A1 | 4/2020 | Xuan et al. | |

FOREIGN PATENT DOCUMENTS

| | | | |
|---|---|---|---|
| CN | 105989787 | A | 10/2016 |
| CN | 107170408 | A | 9/2017 |
| CN | 107424569 | A | 12/2017 |

* cited by examiner

DRIVING CIRCUIT, DISPLAY PANEL, DRIVING METHOD AND DISPLAY DEVICE

CROSS-REFERENCE TO RELATED APPLICATION

This application claims priority of Chinese Patent Application No. 201911000241.5, filed on Oct. 21, 2019, which is hereby incorporated by reference in its entirety.

FIELD

The present disclosure relates to the technical field of display, in particular to a driving circuit, a display panel, a driving method and a display device.

BACKGROUND

Organic Light Emitting Diode (OLED) panels have the characteristics of being flexible, high in contrast, low in power consumption and the like, and have attracted widespread attention. Pixel circuits are the core technical content of the OLED panels and are of important research significance.

SUMMARY

A driving circuit provided by an embodiment of the present disclosure includes a pixel circuit and a plurality of light emitting devices; the pixel circuit includes a data control circuit, a light emitting control circuit and a driving transistor, wherein the data control circuit is configured to supply a signal of a data signal terminal to a gate of the driving transistor under the signal control of a scanning signal terminal, and supply a signal of a reference voltage signal terminal to the gate of the driving transistor under the signal control of a reset signal terminal;

the light emitting control circuit is configured to electrically connect the plurality of light emitting devices to a second electrode of the driving transistor in a time-sharing manner under the signal control of a plurality of light emitting control signal terminals; and a first electrode of the driving transistor is electrically connected with a power voltage terminal.

Optionally, the scanning signal terminal includes a first subscanning signal terminal and a second subscanning signal terminal; the data control circuit includes: a first switching transistor, a second switching transistor, a third switching transistor and a first capacitor;

a first terminal of the first switching transistor is electrically connected to the data signal terminal, a control terminal of the first switching transistor is electrically connected to the first subscanning signal terminal, and a second terminal of the first switching transistor is electrically connected to a gate of the driving transistor;

a first terminal of the second switching transistor is electrically connected to the data signal terminal, a control terminal of the second switching transistor is electrically connected to the second sub scanning signal terminal, and a second terminal of the second switching transistor is electrically connected to the gate of the driving transistor;

a first terminal of the third switching transistor is electrically connected to the gate of the driving transistor, a control terminal of the third switching transistor is electrically connected to the reset signal terminal, and a second terminal of the third switching transistor is electrically connected to the reference voltage signal terminal; and a first terminal of the first capacitor is electrically connected to the gate of the driving transistor, and a second terminal of the first capacitor is electrically connected to the reference voltage signal terminal.

Optionally, the data control circuit includes a fourth switching transistor, a fifth switching transistor and a second capacitor, wherein a first terminal of the fourth switching transistor is electrically connected to the data signal terminal, a control terminal of the fourth switching transistor is electrically connected to the scanning signal terminal, and a second terminal of the fourth switching transistor is electrically connected to the gate of the driving transistor;

a first terminal of the fifth switching transistor is electrically connected to the gate of the driving transistor, a control terminal of the fifth switching transistor is electrically connected to the reset signal terminal, and a second terminal of the fifth switching transistor is electrically connected to the reference voltage signal terminal; and a first terminal of the second capacitor is electrically connected to the gate of the driving transistor, and a second terminal of the second capacitor is electrically connected to the reference voltage signal terminal.

Optionally, the light emitting control circuit includes a plurality of light emitting control transistors, wherein one light emitting control transistor corresponds to one light emitting device, and one light emitting control transistor corresponds to one light emitting control signal terminals; and a first terminal of each light emitting control transistor is electrically connected to a second electrode of the driving transistor, a second terminal of each light emitting control transistor is electrically connected to the corresponding light emitting device, and a control terminal of each light emitting control transistor is electrically connected to the corresponding light emitting control signal terminal.

Correspondingly, an embodiment of the present disclosure provides a display panel including a plurality of sub-pixels arranged in an array; the plurality of sub-pixels are divided into a plurality of sub-pixel groups; one of the sub-pixel groups is correspondingly provided with any one of the above driving circuits; one sub-pixel of each sub-pixel group is correspondingly provided with one light emitting device in the driving circuit.

Optionally, the plurality of sub-pixels include first-color sub-pixels, second-color sub-pixels and third-color sub-pixels;

in every two adjacent sub-pixel columns, the second-color sub-pixels are sequentially arranged in one sub-pixel column, and the first-color sub-pixels and the third-color sub-pixels are alternately arranged in the other sub-pixel column.

Optionally, each sub-pixel group includes at least two sub-pixels adjacent in a column direction of the sub-pixels; or each sub-pixel group includes at least two sub-pixels adjacent in a row direction of the sub-pixels.

Correspondingly, an embodiment of the present disclosure further provides a display device including any one of the above display panel.

Correspondingly, an embodiment of the present disclosure further provides a driving method for the above any driving circuit, including the following steps:

in a display cycle, the light emitting devices in the driving circuit are controlled to be turned on in a time-sharing manner, wherein the display cycle includes a plurality of driving cycles; in the same display cycle, the light emitting devices driven by the light emitting control circuit to emit light are different in different driving cycles;

the driving cycle includes:

a reset phase in which the data control circuit supplies the signal of the reference voltage signal terminal to the gate of the driving transistor under the signal control of the reset signal terminal; and a data input phase in which the data control circuit supplies the signal of the data signal terminal to the gate of the driving transistor under the signal control of the scanning signal terminal; and a light emitting phase in which the light control circuit supplies a signal of the second electrode of the driving transistor to the corresponding light emitting device under the signal control of one of the light emitting control signal terminals.

Optionally, the driving circuit includes two light emitting devices, and each display cycle includes: a first driving cycle and a second driving cycle, wherein the first driving cycle includes:

a reset phase in which the data control circuit supplies the signal of the reference voltage signal terminal to the gate of the driving transistor under the signal control of the reset signal terminal;

a data input phase in which the data control circuit supplies the signal of the data signal terminal to the gate of the driving transistor under the signal control of the scanning signal terminal; and a light emitting phase in which the light emitting control circuit supplies the signal of the second electrode of the driving transistor to one of the two light emitting devices under the signal control of one of the light emitting control signal terminals;

the second driving cycle includes:

a reset phase in which the data control circuit supplies the signal of the reference voltage signal terminal to the gate of the driving transistor under the signal control of the reset signal terminal;

a data input phase in which the data control circuit supplies the signal of the data signal terminal to the gate of the driving transistor under the signal control of the scanning signal terminal; and a light emitting phase in which the light emitting control circuit supplies the signal of the second electrode of the driving transistor to the other light emitting device of the two light emitting devices under the signal control of the other light emitting control signal terminal.

DETAILED DESCRIPTION OF THE EMBODIMENTS

Figure 1:
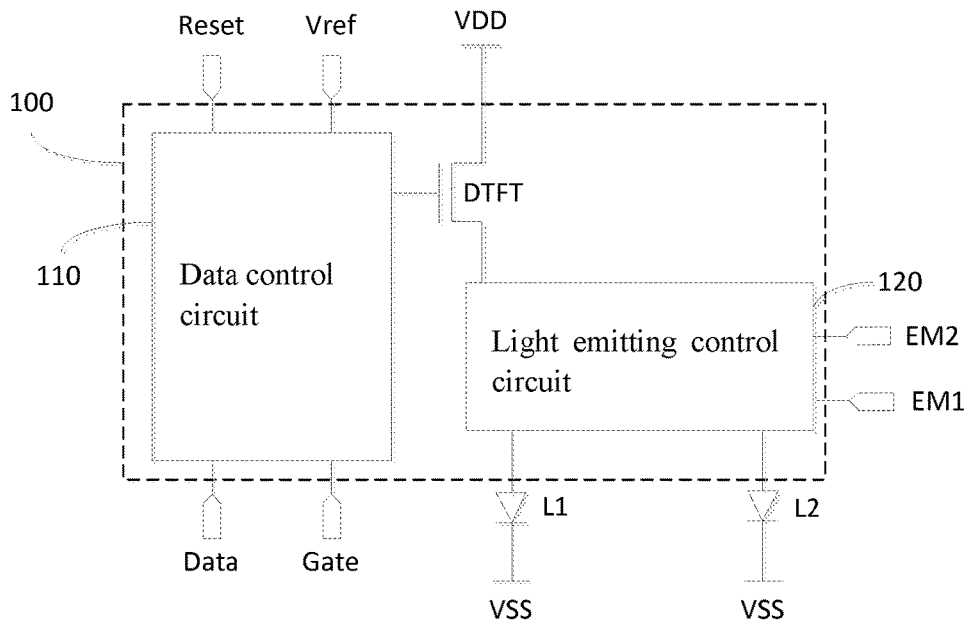
FIG. 1 is a structural schematic diagram of a driving circuit according to an embodiment of the present disclosure.

In order to make the objectives, technical solutions and advantages of the embodiments of the present disclosure clearer, the technical solutions of the embodiments of the present disclosure will be clearly and completely described below in combination with accompanying drawings of the embodiments of the present disclosure. Obviously, the described embodiments are a part of embodiments of the present disclosure, but not all the embodiments. The embodiments of the present disclosure and the features in the embodiments can be combined mutually under the condition of no confliction. Based on the described embodiments of the present disclosure, all other embodiments obtained by ordinary those skilled in the art without creative labor shall fall within the protection scope of the present disclosure.

Unless otherwise defined, the technical terms or scientific terms used in the present disclosure shall have the ordinary meanings understood by ordinary those skilled in the field to which the present disclosure belongs. The terms of "first", "second" and similar terms used in the present disclosure do not indicate any order, quantity or importance, but are only used to distinguish different components. Terms such as "comprising" or "including" mean that elements or items used in front of the terms cover the elements or items and the equivalent thereof appearing used behind the terms without excluding other elements or items. Terms such as "connection" or "electric connection" are not limited to physical or mechanical connection, but may include electrical connection, both direct connection and indirect connection.

It should be noted that the sizes and shapes of the figures in the accompanying drawings do not reflect the true proportion, and only aim at illustrating the content of the present disclosure. The same or similar reference numerals indicate same or similar elements or elements with same or similar functions throughout.

Due to related OLED process limitations, it is difficult to further reduce the sizes of driving transistors in the pixel circuits, and the resolutions of the OLED panels are therefore limited. If the sizes of storage capacitors in the pixel circuits are reduced for improving the resolutions of the OLED panels, the problem that the brightness of the OLEDs is unstable may be caused.

As shown in FIG. 1, a driving circuit provided by an embodiment of the present disclosure includes: a pixel circuit 100 and multiple light emitting devices; the pixel circuit 100 includes: a data control circuit 110, a light emitting control circuit 120 and a driving transistor DTFT.

The data control circuit 110 is configured to supply a signal of a data signal terminal Data to a gate of the driving transistor DTFT under signal control of a scanning signal terminal Gate, and supply a signal of a reference voltage signal terminal Vref to the gate of the driving transistor DTFT under signal control of a reset signal terminal Reset.

The light emitting control circuit 120 is configured to electrically connect the multiple light emitting devices to a second electrode of the driving transistor DTFT in a time-sharing manner under signal control of multiple light emitting control signal terminals.

A first electrode of the driving transistor DTFT is electrically connected to a power voltage terminal VDD.

The driving circuit provided by the embodiment of the present disclosure includes a pixel circuit 100 and multiple light emitting devices; the pixel circuit 100 includes: a data control circuit 110, a light emitting control circuit 120 and a driving transistor DTFT, wherein at least two light emitting devices share the same pixel circuit 100, and thus the multiple light emitting devices can be driven to emit light through the functions of the data control circuit 110, the light emitting control circuit 120 and the driving transistor DTFT. When the driving circuit is applied to a display panel, an occupied area of the pixel circuit in a display area can be reduced, and thus, more pixel circuits and light emitting devices can be arranged in the display area, and the resolution of the display panel can be improved.

In addition, by controlling the light emitting control circuit 120 through signals of the multiple light emitting control signal terminals, the multiple light emitting devices can be controlled to emit light in a time-sharing manner.

Figure 2:
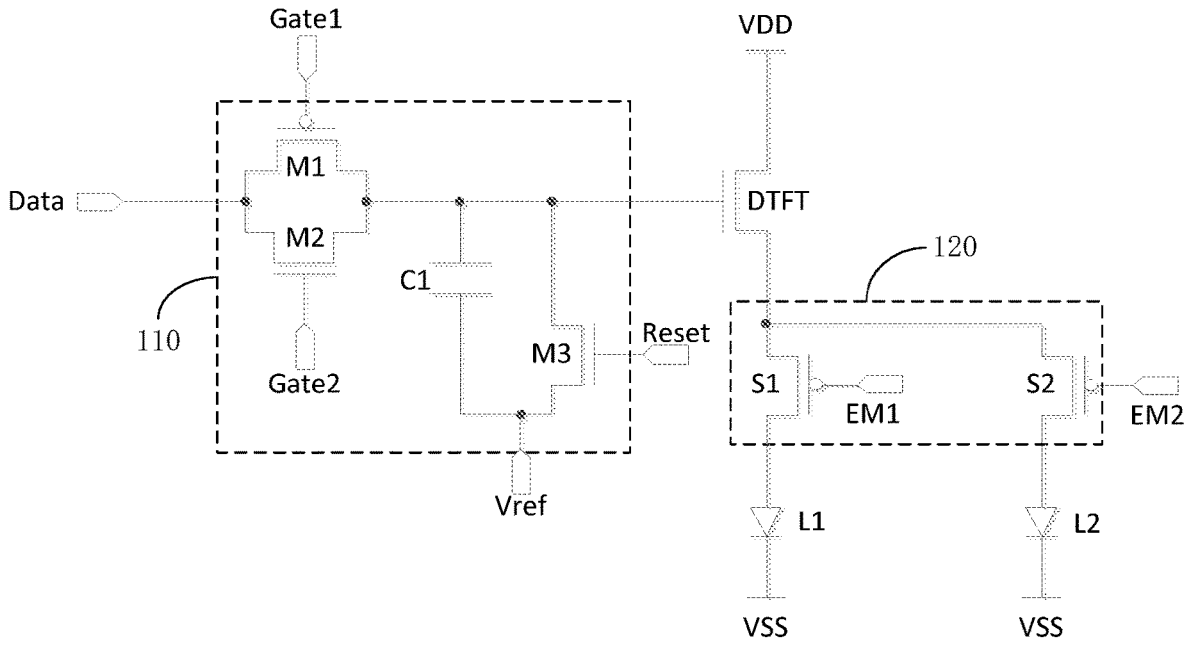
FIG. 2 is a specific structural schematic diagram of a driving circuit according to an embodiment of the present disclosure.

In specific implementation, in the driving circuit provided by the embodiment of the present disclosure, as shown in FIG. 2, the data control circuit 110 includes a first switching transistor M1, a second switching transistor M2, a third switching transistor M3 and a first capacitor C1. The scanning signal terminal Gate includes a first subscanning signal terminal Gate1 and a second subscanning signal terminal Gate2.

A first terminal of the first switching transistor M1 is electrically connected to the data signal terminal Data, a control terminal of the first switching transistor M1 is electrically connected to the first subscanning signal terminal Gate1, and a second terminal of the first switching transistor M1 is electrically connected to the gate of the driving transistor DTFT.

A first terminal of the second switching transistor M2 is electrically connected to the data signal terminal Data, a control terminal of the second switching transistor M2 is electrically connected to the second subscanning signal terminal Gate2, and a second terminal of the second switching transistor M2 is connected to the gate of the driving transistor DTFT.

A first terminal of the third switching transistor M3 is electrically connected to the gate of the driving transistor DTFT, a control terminal of the third switching transistor M3 is electrically connected to the reset signal terminal Reset, and a second terminal of the third switching transistor M3 is electrically connected to the reference voltage signal terminal Vref.

A first terminal of the first capacitor C1 is electrically connected to the gate of the driving transistor DTFT, and a second terminal of the first capacitor C1 is electrically connected to the reference voltage signal terminal Vref.

In specific implementation, when the first switching transistor M1 is in a turning on state under signal control of the first subscanning signal terminal Gate1, the first switching transistor M1 can supply the signal of the data signal terminal Data to the gate of the driving transistor DTFT.

In specific implementation, when the second switching transistor M2 is in a turning on state under signal control of the second sub scanning signal terminal Gate2, the second switching transistor M2 can supply the signal of the data signal terminal Data to the gate of the driving transistor DTFT.

In specific implementation, when the third switching transistor M3 is in a turning on state under signal control of the reset signal terminal Reset, the third switching transistor M3 can supply the signal of the reference voltage signal terminal Vref to the gate of the driving transistor DTFT.

In specific implementation, the first capacitor C1 is used to store a voltage input to two ends of the first capacitor C1 and keep a voltage difference between the two ends stable. For example, the first capacitor C1 may store a voltage input to the gate of the driving transistor DTFT. When the gate of the driving transistor DTFT is in a floating state, the voltage difference between the first terminal of the first capacitor C1 and the gate of the driving transistor DTFT is kept stable.

In specific implementation, as shown in FIG. 2, the first switching transistor M1 is a P-type transistor, and the second switching transistor M2 is an N-type transistor; or the first switching transistor M1 may be an N-type transistor, and the second switching transistor M2 may be a P-type transistor.

In specific implementation, by arranging the first switching transistor M1 and the second switching transistor M2, the range of a signal voltage of the gate of the driving transistor DTFT can be increased, which equivalently means that the range of a signal voltage of the second electrode of the driving transistor DTFT is increased, and thus the range of light emitting voltages of the light emitting devices can be increased.

In specific implementation, the first switching transistor M1 and the second switching transistor M2 may be TFT characteristic curve symmetrical triodes, that is, a threshold voltage Vth(P) of the first switching transistor M1 and a threshold voltage Vth(N) of the second switching transistor M2 are the same, that is, Vth(P)=−Vth(N). In this way, voltage glitches generated when the first switching transistor M1 and the second switching transistor M2 are turned on and off can offset each other, and therefore noise is reduced.

Figure 3:
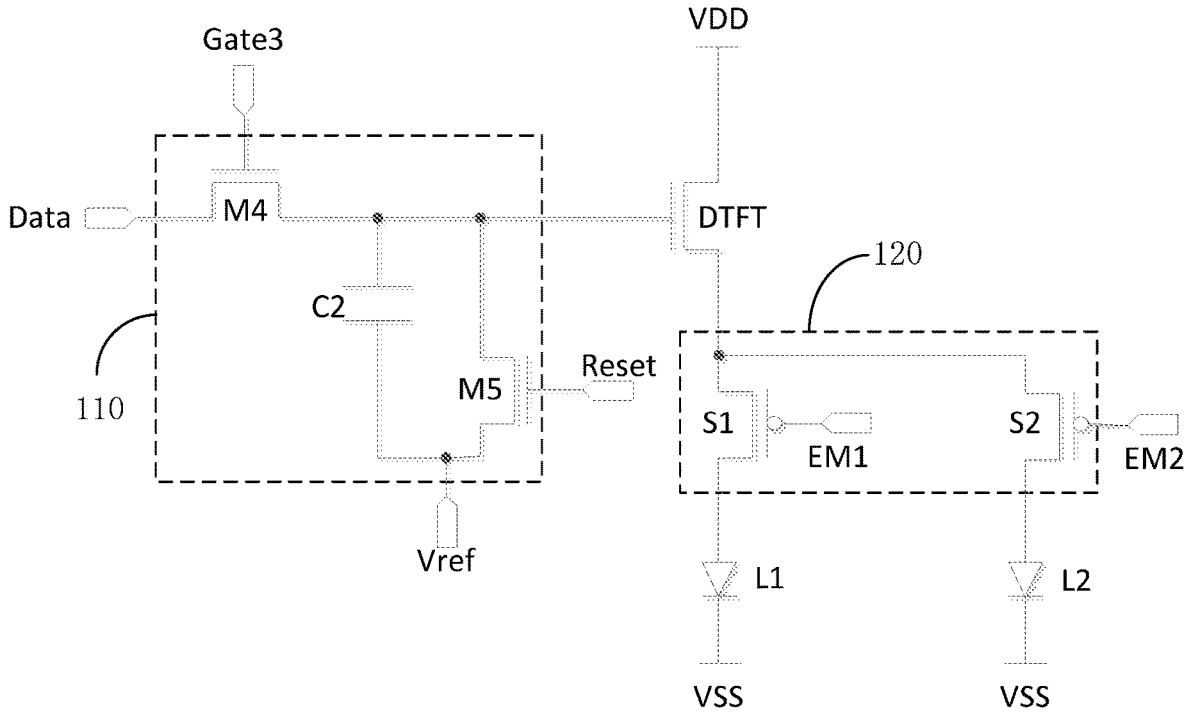
FIG. 3 is a specific structural schematic diagram of another driving circuit according to an embodiment of the present disclosure.

Alternatively, in specific implementation, in the driving circuit provided by the embodiment of the present disclosure, as shown in FIG. 3, the scanning signal terminal Gate may also include a third scanning signal terminal Gate3, and the data control circuit 110 includes a fourth switching transistor M4, a fifth switching transistor M5 and a second capacitor C2.

A first terminal of the fourth switching transistor M4 is electrically connected to the data signal terminal Data, a control terminal of the fourth switching transistor M4 is electrically connected to the third scanning signal terminal Gate3, and a second terminal of the fourth switching transistor M4 is electrically connected to the gate of the driving transistor DTFT.

A first terminal of the fifth switching transistor M5 is electrically connected to the gate of the driving transistor DTFT, a control terminal of the fifth switching transistor M5 is electrically connected to the reset signal terminal Reset, and a second terminal of the fifth switching transistor M5 is electrically connected to the reference voltage signal terminal Vref.

A first terminal of the second capacitor C2 is electrically connected to the gate of the driving transistor DTFT, and a second terminal of the second capacitor C2 is electrically connected to the reference voltage signal terminal Vref.

In specific implementation, when the fourth switching transistor M4 is in a turning on state under signal control of the third scanning signal terminal Gate3, the fourth switching transistor M4 can supply the signal of the data signal terminal Data to the gate of the driving transistor DTFT.

In specific implementation, when the fifth switching transistor M5 is in a turning on state under the signal control of the reset signal terminal Reset, the fifth switching transistor M5 can supply the signal of the reference voltage signal terminal Vref to the gate of the driving transistor DTFT.

In specific implementation, the second capacitor C2 is used for storing a voltage input to two ends of the second capacitor C2 and keeping a voltage difference between the two ends of the second capacitor C2 stable. For example, the second capacitor C2 may store a voltage input to the gate of the driving transistor DTFT. When the gate of the driving transistor DTFT is in a floating state, the voltage difference between the first terminal of the second capacitor C2 and the gate of the driving transistor DTFT is kept stable.

In specific implementation, in the driving circuit provided by the embodiment of the present disclosure, as shown in FIG. 2 and FIG. 3, the light emitting control circuit 120 includes multiple light emitting control transistors, wherein each light emitting control transistor corresponds to one light emitting device, and each light emitting control transistor corresponds to one light emitting control signal terminal.

First terminals of the light emitting control transistors are electrically connected to the second electrode of the driving transistor DTFT, second terminals of the light emitting control transistors are electrically connected to the corresponding light emitting devices, and control terminals of the light emitting control transistors are electrically connected to the corresponding light emitting control signal terminals. In specific implementation, the light emitting control transistors are used for supplying a signal of the second electrode of the driving transistor DTFT to the corresponding light emitting device under signal control of the corresponding light emitting control signal terminals.

In specific implementation, as shown in FIG. 2 and FIG. 3, the light emitting control circuit 120 includes two light emitting control transistors, namely a first light emitting control transistor S1 and a second light emitting control transistor S2; the driving circuit includes two light emitting devices, namely a first light emitting device L1 and a second light emitting device L2; two light emitting control signal terminals are arranged and include a first light emitting control signal terminal EM1 and a second light emitting control signal terminal EM2, wherein a first terminal of the first light emitting control transistor S1 is electrically connected to the second electrode of the driving transistor DTFT, a control terminal of the first light emitting control transistor S1 is electrically connected to the first light emitting control signal terminal EM1, and a second terminal of the first light emitting control transistor S1 is electrically connected to the first light emitting device L1; a first terminal of the second light emitting control transistor S2 is electrically connected to the second electrode of the driving transistor DTFT, a control terminal of the second light emitting control transistor S2 is electrically connected to the second light emitting control signal terminal EM2, and a second terminal of the second light emitting control transistor S2 is electrically connected to the second light emitting device L2. Certainly, the present disclosure includes the above content but is not limited to this, the light emitting control circuit 120 may include three or four or more light emitting control transistors, and three or four or more light emitting devices and light emitting control signal terminals corresponding to the light emitting control transistors are arranged correspondingly.

In specific implementation, the light emitting devices may be at least one of organic light emitting diodes (OLED), micro light emitting diodes (Micro-LED) and quantum dot Light emitting diodes (QLED).

In specific implementation, as shown in FIG. 2, the light emitting control transistors may be P-type transistors, the first switching transistor M1 may be a P-type transistor, the second switching transistor M2 may be an N-type transistor, and the third switching transistor M3 may be an N-type transistor; and as shown in FIG. 3, the light emitting control transistors may be P-type transistors, the fourth switching transistor M4 may be an N-type transistor, and the fifth switching transistor M5 may be an N-type transistor. Certainly, the present disclosure includes the above content but is not limited to this.

In addition, the above transistors may be thin film transistors (TFT) or metal oxide semiconductor field effect transistors (MOS), which are not limited herein. According to the different types of the above transistors and different signals of the control terminals of the transistors, the control terminals of the above transistors can be used as gates, the first terminals of the above transistors can be used as source electrodes, and the second terminals of the above transistors can be used as drain electrodes, or the first terminals of the transistors can be used as the drain electrodes, and the second terminals of the transistors can be used as the source electrodes, which are not specifically distinguished herein.

In specific implementation, the driving transistor DTFT may be a silicon-based MOS or other known transistors, which is not limited herein.

The present disclosure is described in detail below in combination with specific embodiments. It should be noted that the embodiments are used to better explain the present disclosure, but not to limit the present disclosure.

The working process of the driving circuit provided by the embodiment of the present disclosure is described below in combination with a circuit timing diagram. In the following description, 1 represents high level and 0 represents low level. It should be noted that 1 and 0 are logic levels, which are only for better explaining the specific working process of the embodiment of the present disclosure, rather than specific voltage values.

Embodiment 1

Figure 7:
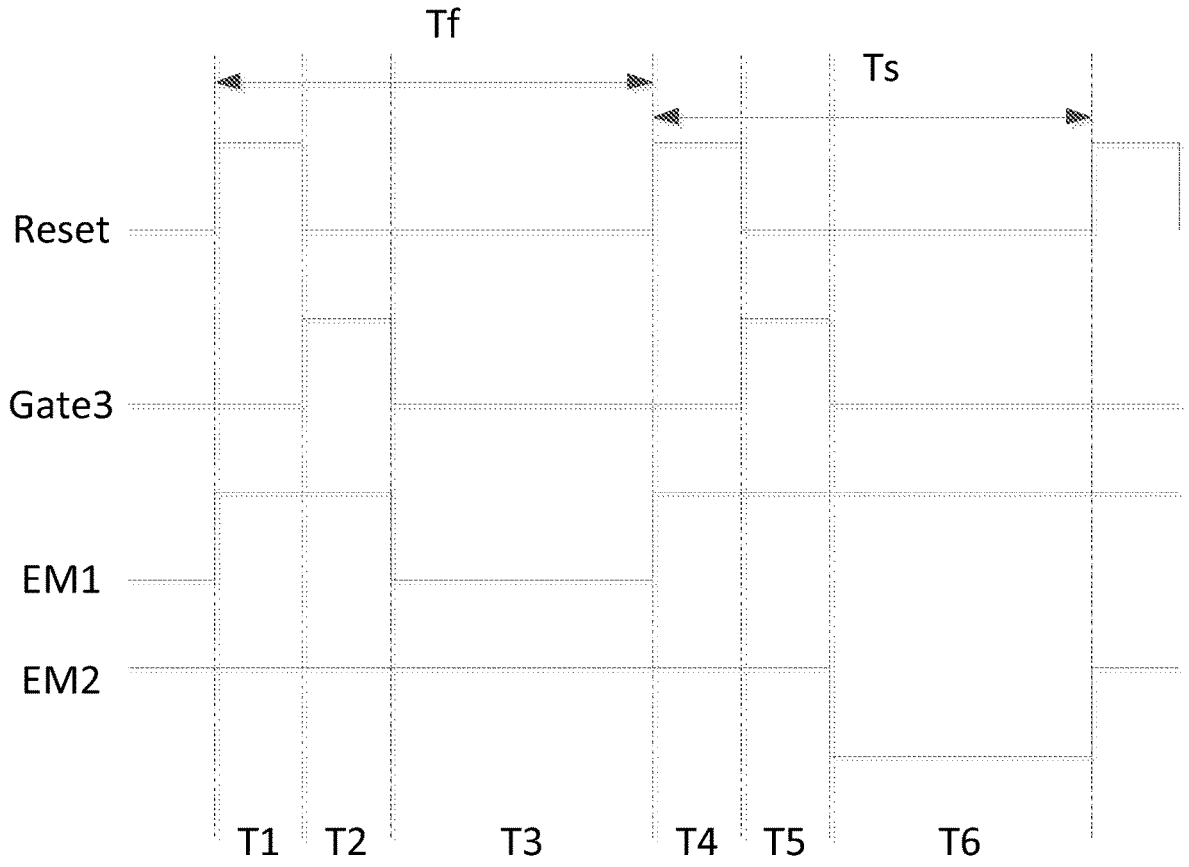
FIG. 7 is a circuit timing diagram according to an embodiment of the present disclosure.

The driving circuit shown in FIG. 3 is taken as an example below, and the working process of the driving circuit provided by the embodiment of the present disclosure will be described in combination with the circuit timing diagram shown in FIG. 7. As shown in FIG. 7, a display cycle T includes a first driving cycle Tf and a second driving cycle Ts. Specifically, a reset phase T1, a data input phase T2 and a light emitting phase T3 in the first driving cycle Tf and a reset phase T4, a data input phase T5 and a light emitting phase T6 in the second driving cycle Ts in the circuit timing diagram shown in FIG. 7 are selected. The threshold voltage of the driving transistor DTFT is Vth.

In the reset phase T1, Reset=1, Gate3=0, EM1=1, and EM2=1.

Due to Reset=1, the fifth switching transistor M5 is turned on; due to Gate3=0, the fourth switching transistor M4 is turned off; due to EM1=1, the first light emitting control transistor S1 is turned off; and due to EM2=1, the second light emitting control transistor S2 is turned off.

The fifth switching transistor M5 is turned on, and the signal of the reference voltage signal terminal Vref is supplied to the gate of the driving transistor DTFT and the first terminal of the second capacitor C2 to be reset. In addition, due to a source following principle, a signal level of the second electrode of the driving transistor DTFT changes to Vref-Vth and is reset.

In the data input phase T2, Reset=0, Gate3=1, EM1=1, and EM2=1.

Due to Reset=0, the fifth switching transistor M5 is turned off; due to Gate3=1, the fourth switching transistor M4 is turned on; due to EM1=1, the first light emitting control transistor S1 is turned off; and due to EM2=1, the second light emitting control transistor S2 is turned off.

The fourth switching transistor M4 is turned on, and a signal level Data1 of the data signal terminal Data in the data input phase T2 is supplied to the gate of the driving transistor DTFT and the first terminal of the second capacitor C2. In addition, due to the source following principle, the signal level of the second electrode of the driving transistor DTFT changes to Data1−Vth.

In the light emitting phase T3, Reset=0, Gate3=0, EM1=0, and EM2=1.

Due to Reset=0, the fifth switching transistor M5 is turned off; due to Gate3=0, the fourth switching transistor M4 is turned off; due to EM1=0, the first light emitting control transistor S1 is turned on; and due to EM2=1, the second light emitting control transistor S2 is turned off.

Due to the function of the second capacitor C2, a signal level of the gate of the driving transistor DTFT is maintained to be Data1, the first light emitting control transistor S1 is turned on, and the signal of the second electrode of the driving transistor DTFT is supplied to the first light emitting device L1, so that the first light emitting device L1 emits light.

In the reset phase T4, Reset=1, Gate3=0, EM1=1, and EM2=1.

Due to Reset=1, the fifth switching transistor M5 is turned on; due to Gate3=0, the fourth switching transistor M4 is turned off; due to EM1=1, the first light emitting control transistor S1 is turned off; and due to EM2=1, the second light emitting control transistor S2 is turned off.

The fifth switching transistor M5 is turned on, and the signal of the reference voltage signal terminal Vref is supplied to the gate of the driving transistor DTFT and the first terminal of the second capacitor C2 to be reset. In addition, due to the source following principle, the signal level of the second electrode of the driving transistor DTFT changes to Vref-Vth and is reset.

In the data input phase T5, Reset=0, Gate3=1, EM1=1 and EM2=1.

Due to Reset=0, the fifth switching transistor M5 is turned off; due to Gate3=1, the fourth switching transistor M4 is turned on; due to EM1=1, the first light emitting control transistor S1 is turned off; and due to EM2=1, the second light emitting control transistor S2 is turned off.

The fourth switching transistor M4 is turned on, and a signal level Data2 of the data signal terminal Data in the data input phase T5 is supplied to the gate of the driving transistor DTFT and the first terminal of the second capacitor C2. In addition, due to the source following principle, the signal level of the second electrode of the driving transistor DTFT changes to Data2−Vth.

In the light emitting phase T6, Reset=0, Gate3=0, EM1=1 and EM2=0.

Due to Reset=0, the fifth switching transistor M5 is turned off; due to Gate3=0, the fourth switching transistor M4 is turned off; due to EM1=1, the first light emitting control transistor S1 is turned off; and due to EM2=0, the second light emitting control transistor S2 is turned on.

Due to the function of the second capacitor C2, the signal level of the gate of the driving transistor DTFT is maintained to be Data2, the first light emitting control transistor S1 is turned off, and the signal of the second electrode of the driving transistor DTFT is supplied to the second light emitting device L2, so that the second light emitting device L2 emits light.

Embodiment 2

Figure 8:
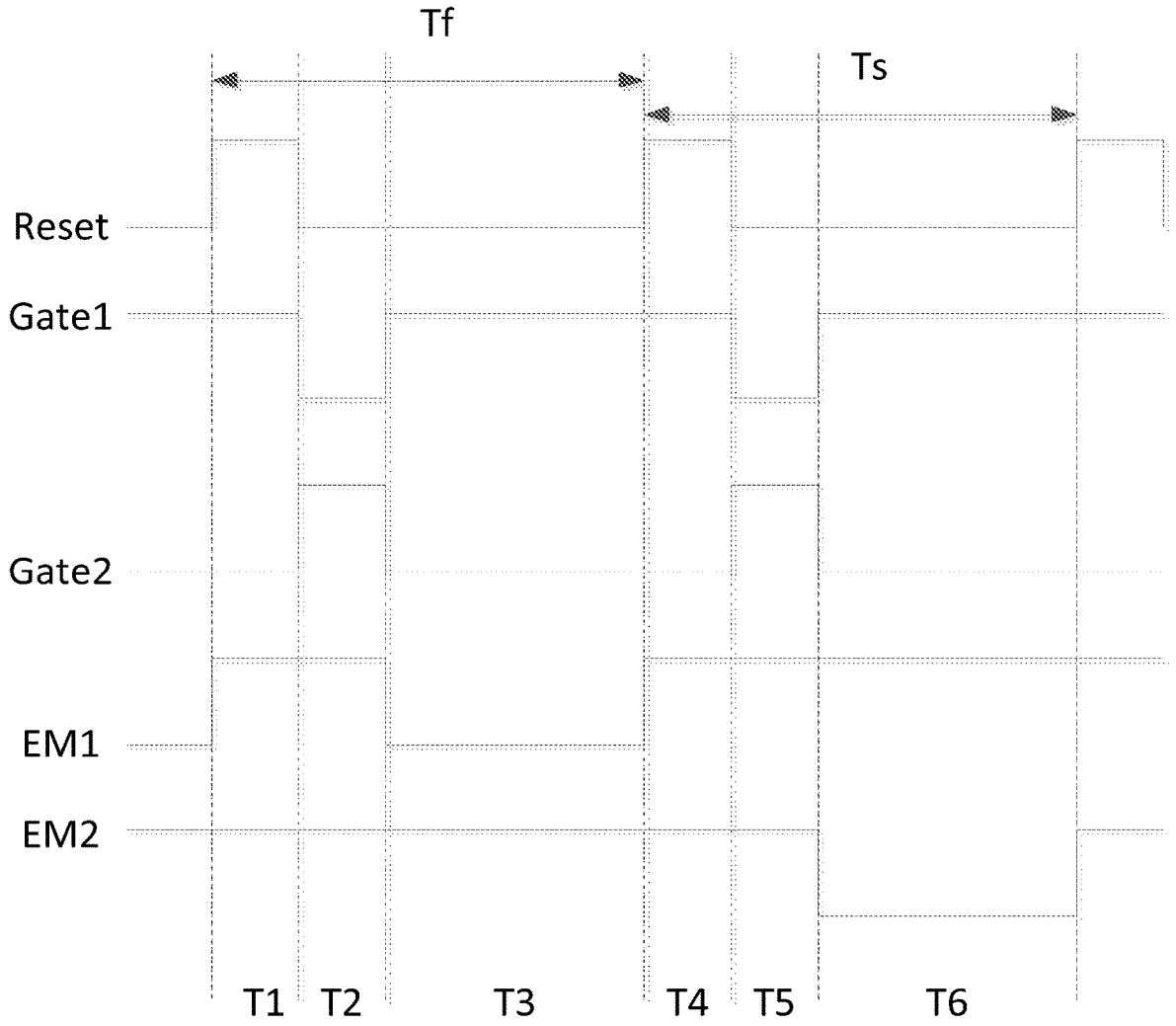
FIG. 8 is another circuit timing diagram according to an embodiment of the present disclosure.

The driving circuit shown in FIG. 2 is taken as an example below, and the working process of the driving circuit provided by the embodiment of the present disclosure is described in combination with the circuit timing diagram shown in FIG. 8. As shown in FIG. 8, a display cycle T includes a first driving cycle Tf and a second driving cycle Ts. A reset phase T1, a data input phase T2 and a light emitting phase T3 in the first driving cycle Tf and a reset phase T4, a data input phase T5 and a light emitting phase T6 in the second driving cycle Ts in the circuit timing diagram shown in FIG. 8 are selected. The threshold voltage of the driving transistor DTFT is Vth, the threshold voltage of the first switching transistor M1 is Vth(P), the threshold voltage of the second switching transistor M2 is Vth(N), the signal voltage of the first scanning signal terminal is Vgate1, and the signal voltage of the second scanning signal terminal is Vgate2.

In the reset phase T1, Reset=1, Gate1=1, Gate2=0, EM1=1 and EM2=1.

Due to Gate1=1, the first switching transistor M1 is turned off; due to Gate2=0, the second switching transistor M2 is turned off; and due to Reset=1, the third switching transistor M3 is turned on. The rest of the work process in the phase may be basically the same as the work process in the reset phase T1 in Embodiment 1, and details are not described herein.

In the data input phase T2, Reset=0, Gate1=0, Gate2=1, EM1=1 and EM2=1.

Due to Gate1=0, the first switching transistor M1 is turned on; due to Gate2=0, the second switching transistor M2 is turned on; due to Reset=0, the third switching transistor M3 is turned off; due to EM1=1, the first light emitting control transistor S1 is turned off; and due to EM2=1, the second light emitting control transistor S2 is turned off.

In the data input phase T2, the signal level of the data signal terminal Data is Data1 and the signal voltage of the date signal terminal Data is Vdata1. Since the first switching transistor M1 is a P-type transistor, when Vgate1−Vdata1<Vth(P), the first switching transistor M1 is turned on, and when Vgate1−Vdata1>Vth(P), the first switching transistor M1 is turned off; since the second switching transistor M2 is an N-type transistor, when Vgate2−Vdata1>Vth(N), the second switching transistor M2 is turned on, and when Vgate2−Vdata1<Vth(N), the second switching transistor M2 is turned off. Therefore, the range of voltage input to the gate of the driving transistor DTFT is widened, that is, the voltage range of the second electrode of the driving transistor DTFT is increased. In the data input phase T2, the signal level Data1 of the data signal terminal Data is supplied to the gate of the driving transistor DTFT via at least one of the first switching transistor M1 and the second switching transistor M2, and due to the source following principle, the signal level of the second electrode of the driving transistor DTFT also changes.

In the light emitting phase T3, Reset=0, Gate1=1, Gate2=0, EM1=0 and EM2=1.

Due to Reset=0, the third switching transistor M3 is turned off; due to Gate1=1, the first switching transistor M1 is turned off; due to Gate2=0, the second switching transistor is turned off; due to EM1=0, the first light emitting control transistor S1 is turned on; and due to EM2=1, the second light emitting control transistor S2 is turned off.

Due to the function of the first capacitor C1, the signal level of the gate of the driving transistor DTFT is maintained to be the signal level in the data input phase T2, the first light emitting control transistor S1 is turned on, and the signal of the second electrode of the driving transistor DTFT is supplied to the first light emitting device L1, so that the first light emitting device L1 emits light.

In the reset phase T4, Reset=1, Gate1=1, Gate2=0, EM1=1 and EM2=1.

Due to Gate1=1, the first switching transistor M1 is turned off; due to Gate2=0, the second switching transistor M2 is turned off; and due to Reset=1, the third switching transistor M3 is turned on. The rest of the work process in the phase may be basically the same as the work process in the reset phase T4 in Embodiment 1, and details are not described herein.

In the data input phase T5, Reset=0, Gate1=0, Gate2=1, EM1=1 and EM2=1.

Due to Gate1=0, the first switching transistor M1 is turned on; due to Gate2=1, the second switching transistor M2 is turned on; due to Reset=0, the third switching transistor M3 is turned off; due to EM1=1, the first light emitting control transistor S1 is turned off; and due to EM2=1, the second light emitting control transistor S2 is turned off.

In the data input phase T5, the signal level Data2 of the data signal terminal Data is supplied to the gate of the driving transistor DTFT via at least one of the first switching transistor M1 and the second switching transistor M2, and due to the source following principle, the signal level of the second electrode of the driving transistor DTFT also changes.

In the light emitting phase T6, Reset=0, Gate1=1, Gate2=0, EM1=1 and EM2=0.

Due to Reset=0, the third switching transistor M3 is turned off; due to Gate1=1, the first switching transistor M1 is turned off; due to Gate2=0, the second switching transistor is turned off; due to EM1=0, the first light emitting control transistor S1 is turned off; and due to EM2=1, the second light emitting control transistor S2 is turned on.

Due to the function of the first capacitor C1, the signal level of the gate of the driving transistor DTFT is maintained to be the signal level in the data input phase T5, the second light emitting control transistor S2 is turned on, and the signal of the second electrode of the driving transistor DTFT is supplied to the second light emitting device L2, so that the second light emitting device L2 emits light.

Based on the same inventive concept, an embodiment of the present disclosure further provides a driving method of the above driving circuit provided by the embodiment of the present disclosure, and the driving method includes:

in the display cycle, the light emitting devices in the driving circuit are controlled to be turned on in a time-sharing manner, wherein the display cycle includes multiple driving cycles; in the same display cycle, the light emitting control circuit 120 drives different light emitting devices in different driving cycles.

Each driving cycle includes:

a reset phase in which the data control circuit 110 supplies the signal of the reference voltage signal terminal Vref to the gate of the driving transistor DTFT under signal control of the reset signal terminal Reset;

a data input phase in which the data control circuit 110 supplies the signal of the data signal terminal Data to the gate of the driving transistor DTFT under signal control of the scanning signal terminal Gate; and a light emitting phase in which the light emitting control circuit 120 supplies the signal of the second electrode of the driving transistor DTFT to the corresponding light emitting device under signal control of one of light emitting control signal terminals.

In specific implementation, the driving circuit may include two light emitting devices, and each display cycle may include: a first driving cycle and a second driving cycle, wherein the first driving cycle includes:

a reset phase in which the data control circuit 110 supplies the signal of the reference voltage signal terminal Vref to the gate of the driving transistor DTFT under the signal control of the reset signal terminal Reset;

a data input phase in which the data control circuit 110 supplies the signal of the data signal terminal Data to the gate of the driving transistor DTFT under signal control of the scanning signal terminal Gate;

a light emitting phase in which the light emitting control circuit 120 supplies the signal of the second electrode of the driving transistor DTFT to one of the two light emitting devices under signal control of one of light emitting control signal terminals;

the second driving cycle includes:

a reset phase in which the data control circuit 110 supplies the signal of the reference voltage signal terminal Vref to the gate of the driving transistor DTFT under signal control of the reset signal terminal Reset;

a data input phase in which the data control circuit 110 supplies the signal of the data signal terminal Data to the gate of the driving transistor DTFT under signal control of the scanning signal terminal Gate; and a light emitting phase in which the light emitting control circuit 120 supplies the signal of the second electrode of the driving transistor DTFT to one of the two light emitting devices under signal control of the other light emitting control signal terminal.

It should be noted that one display cycle refers to the time for displaying a complete picture. One driving cycle refers to once scan time for a display panel to scan from a first row of driving circuits to a last row of driving circuits. For example, when a display cycle includes multiple driving cycles, the display panel scans once and writes part of screen data into the driving circuits in one driving cycle, and after all the driving cycles in one display cycle are completed, due to the visual persistence effect of human eyes, a complete picture can be displayed.

Figure 4:
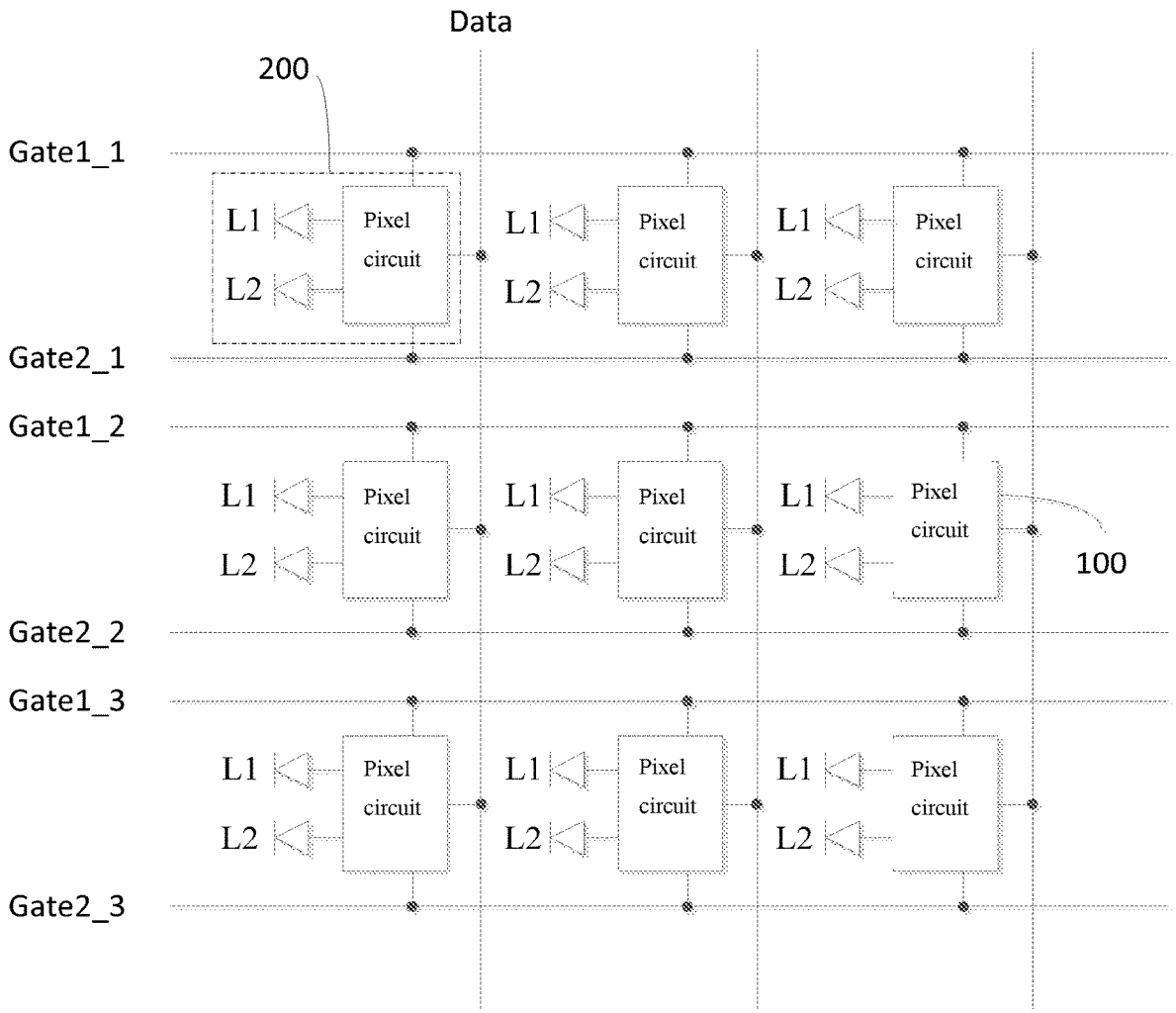
FIG. 4 is a structural schematic diagram of a display panel according to an embodiment of the present disclosure.
Figure 5:
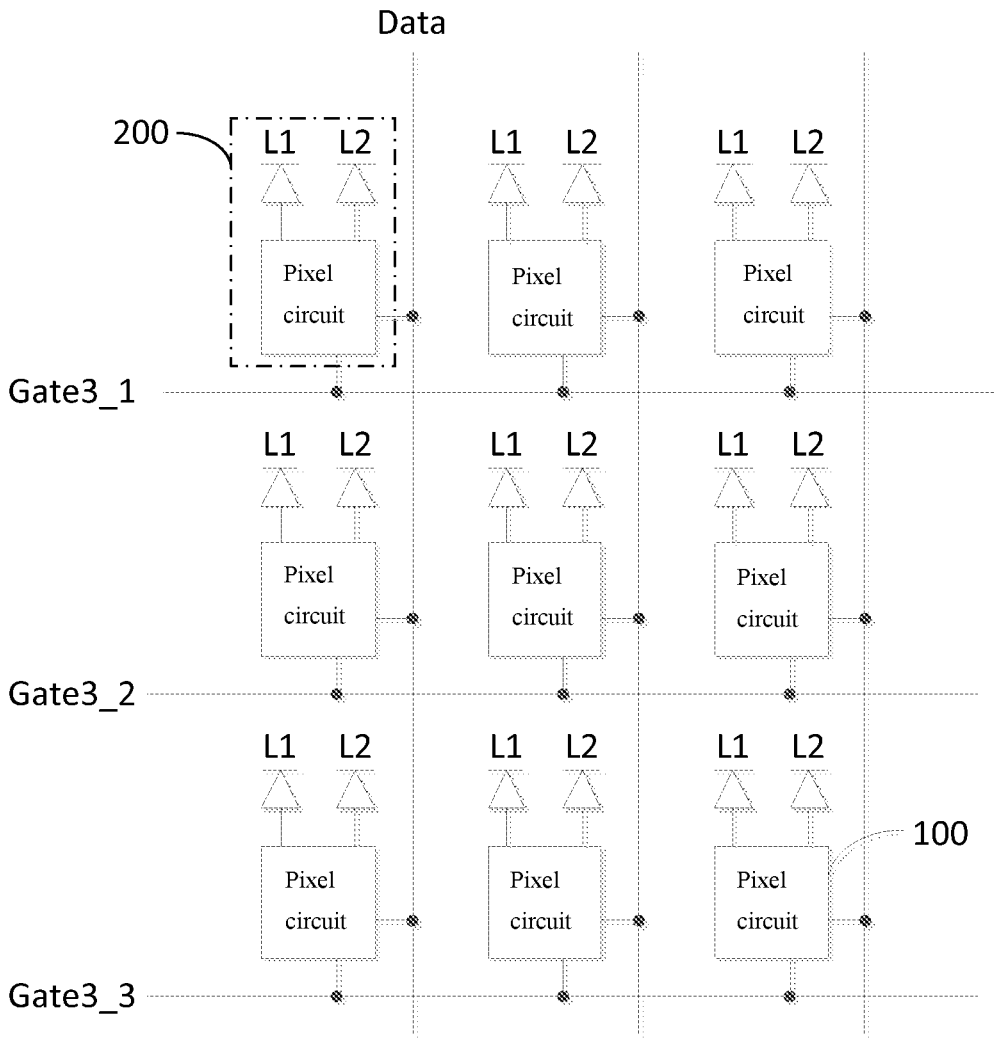
FIG. 5 is a structural schematic diagram of another display panel according to an embodiment of the present disclosure.

Based on the same inventive concept, an embodiment of the present disclosure further provides a display panel, as shown in FIG. 4 and FIG. 5, the display panel includes multiple sub-pixels arranged in an array; the multiple sub-pixels are divided into multiple sub-pixel groups 200; each sub-pixel group 200 corresponds to any one of the above driving circuits; and each sub-pixel of each sub-pixel group 200 corresponds to one light emitting device in the driving circuit. The structure of the driving circuit can be referred to the above description, and will not be repeated here.

In specific implementation, in the embodiment of the present disclosure, the display panel further includes a base substrate. A layer where a pixel circuit 100 is located is arranged on one side of the base substrate, and a layer where the light emitting devices are located is arranged on one side, away from the base substrate, of the layer where the pixel circuit 100 is located. That is, the pixel circuit 100 is prepared on the base substrate at first, and then the light emitting devices are prepared.

Exemplarily, as shown in FIG. 4 and FIG. 5, one driving circuit includes one pixel circuit 100 and two light emitting devices L1 and L2.

Since transistors have a certain range of size, when the number of transistors is constant, the area of the sub-pixels is determined according to the size of the transistors. In the display panel provided by the embodiment of the present disclosure, each sub-pixel includes multiple light emitting devices, and includes only one driving transistor DTFT, a data control circuit 110 and a light emitting control circuit 120. Therefore, when the number of light emitting devices is the same, the number of the transistors required to be arranged can be greatly reduced compared with the prior art. Therefore, in the display panel of the embodiment of the present disclosure, more light emitting devices can be arranged in a unit area, that is, the resolution of the display panel can be greatly improved.

In specific implementation, as shown in FIG. 4 and FIG. 5, the display panel provided by the embodiment of the present disclosure further includes multiple data lines Data and multiple scanning lines. Each data line Data is electrically connected to a column of sub-pixel groups 200, and each scanning line is electrically connected to a row of sub-pixel groups 200.

In specific implementation, the multiple sub-pixels arranged in an array are located in a display area of the display panel. The multiple sub-pixels include first-color sub-pixels, second-color sub-pixels and third-color sub-pixels. Exemplarily, the first-color sub-pixels may be red sub-pixels, the second-color sub-pixels may be green sub-pixels, and the third-color sub-pixels may be blue sub-pixels. In this way, red, green and blue colors may be mixed to realize color display. Alternatively, the multiple sub-pixels may further include fourth-color sub-pixels. For example, the fourth-color sub-pixels may be white sub-pixels. In this way, red, green, blue and white colors may be mixed to realize color display.

Figure 6:
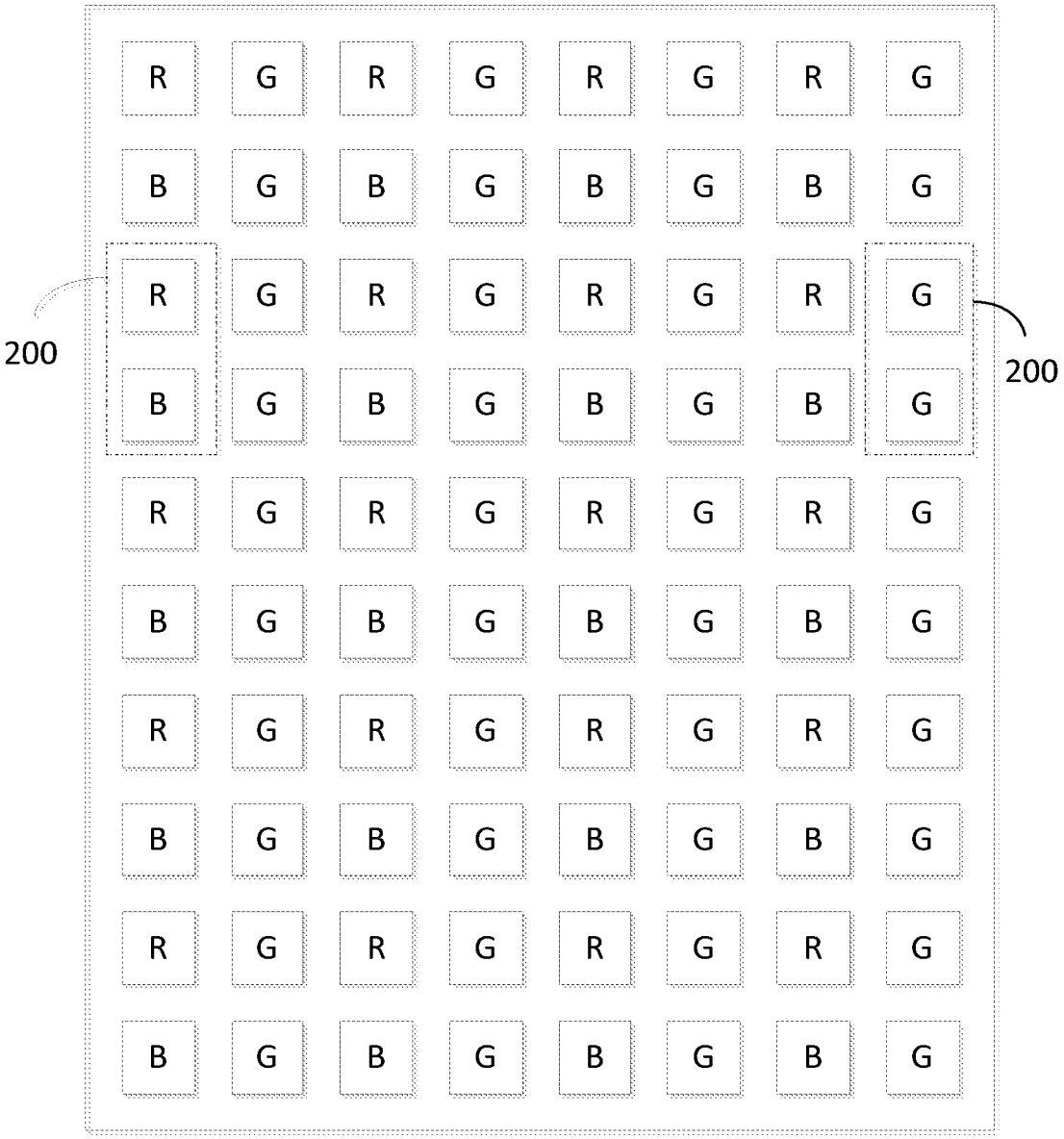
FIG. 6 is a structural schematic diagram of another display panel according to an embodiment of the present disclosure.

In specific implementation, in the display panel provided by the embodiment of the present disclosure, among every two adjacent sub-pixel columns, the second-color sub-pixels in one sub-pixel column are sequentially arranged, and the first-color sub-pixels and the third-color sub-pixels in the other sub-pixel column are alternately arranged. Exemplarily, as shown in FIG. 6, R represents the red sub-pixels, B represents the blue sub-pixels, and G represents the green sub-pixels, the red sub-pixels and the blue sub-pixels are alternately arranged in the odd columns, and the green sub-pixels are sequentially arranged in the even columns.

In specific implementation, since each sub-pixel group 200 in the embodiment of the present disclosure includes the multiple sub-pixels, each sub-pixel group 200 may include only sub-pixels with the same color, for example, only multiple red sub-pixels; each sub-pixel group 200 may also include at least two sub-pixels with different colors, for example, blue sub-pixels and green sub-pixels.

In specific implementation, in the display panel provided by the embodiment of the present disclosure, each sub-pixel group 200 includes at least two sub-pixels adjacent to each other in a column direction of the sub-pixels. Exemplarily, as shown in FIG. 4, each sub-pixel group 200 may include at least two sub-pixels with the same color which are adjacent in the column direction of the sub-pixels. Further, as shown in FIG. 6, a driving circuit including two light emitting devices is taken as an example. In the odd-numbered columns, in the same sub-pixel group 200, the same sub-pixels are spaced by sub-pixels with other colors. For example, in the same sub-pixel group 200, two first-color sub-pixels are spaced by one third-color sub-pixel. In addition, in the same sub-pixel group 200, two third-color sub-pixels are spaced by one first-color sub-pixel. In the even-numbered columns, in the same sub-pixel group 200, two second-color sub-pixels are sequentially arranged.

Alternatively, as shown in FIG. 5, each sub-pixel group 200 includes at least two sub-pixels adjacent in a row direction of the sub-pixels. Exemplarily, as shown in FIG. 5, each sub-pixel group 200 may include at least two sub-pixels with the same color which are adjacent in the row direction of the sub-pixels.

Certainly, the present disclosure includes the above content but is not limited to this. In practical application, light emission colors of the sub-pixels included in the sub-pixel groups 200 may be determined by design according to an actual application environment, which is not limited herein.

The display panel shown in FIG. 6 is taken as an example below to describe the working process of the display panel provided by the embodiment of the present disclosure. It should be noted that the embodiment is to better explain the present disclosure, but not to limit the present disclosure. Each sub-pixel group 200 in the display panel shown in FIG. 6 includes a driving circuit shown in FIG. 2. According to the driving method of the driving circuit, each display cycle corresponds to a display frame, each driving cycle corresponds to a scanning frame, that is, each display frame includes two scanning frames.

In the first scanning frame of one display frame, the first light emitting control transistors S1 in the display panel are turned on row by row, and the second light emitting control transistors S2 are turned off, that is, the odd-numbered rows of sub-pixels (the first row of subpixels in any row of sub-pixel groups) emit light row by row, and the even-numbered rows of subpixels (the second row of subpixels in any row of the subpixel groups) do not emit light. In the second scanning frame of one display frame, the second light emitting control transistors S2 are turned on row by row, and first light emitting control transistors S1 are turned off, that is, even-numbered rows of sub-pixels in the display panel emit light row by row, and odd-numbered rows of sub-pixels do not emit light. In summary, in one scanning frame in the display frame, only a part of the sub-pixels in the display panel emit light, and in the other scanning frame in the display frame, the other part of the sub-pixels emit light.

Due to the visual persistence phenomenon of the human eyes, when a display refresh rate is higher than a certain frequency (for example, the display refresh rate may be 60 Hz or higher, and the present disclosure is not limited to the display refresh rate certainly), the human eyes cannot distinguish different lighting conditions in the display frame, so that the sub-pixels of the display panel in the display frame emit light in a time-sharing manner without affecting the display effect.

Based on the same inventive concept, an embodiment of the present disclosure further provides a display device, and the display device includes any display panel provided by the embodiments of the present disclosure. Implementation of the display device may refer to the embodiments of the above display panel, and repeated details are not described again.

In specific implementation, the display device may be any product or component with a display function, such as a mobile phone, a tablet computer, a television, a display, a notebook computer, a digital photo frame and a navigator. Other essential components of the display device are understood by ordinary those skilled in the art, which will not be repeated here and should not be used as a limitation on the present disclosure.

According to the driving circuit, the display panel, the driving method and the display device provided by the embodiments of the disclosure, the driving circuit includes the pixel circuit and the multiple light emitting devices; the pixel circuit includes: the data control circuit, the light emitting control circuit and the driving transistor, wherein at least two light emitting devices share the same pixel circuit, and thus, the multiple light emitting devices can be driven by the pixel circuit to emit light; and due to the effect of the light emitting control circuit, the multiple light emitting devices can be controlled to emit light in a time-sharing manner. The display panel provided by the embodiment of the present disclosure includes any one of the above driving circuits, and more light emitting devices can be arranged in the display panel per unit area, so that the resolution of the display panel is greatly improved.

Obviously, those skilled in the art can make various modifications and variations to the present disclosure without departing from the spirit and scope of the present disclosure. In this way, if the modifications and variations of the present disclosure fall within the scope of the claims of the present disclosure and the equivalent technologies, the present disclosure is also intended to include the modifications and variations.

The invention claimed is:

1. A driving circuit, comprising: a pixel circuit and a plurality of light emitting devices; the pixel circuit comprises: a data control circuit, a light emitting control circuit and a driving transistor, wherein the data control circuit is configured to supply a signal of a data signal terminal to a gate of the driving transistor under signal control of a scanning signal terminal, and supply a signal of a reference voltage signal terminal to the gate of the driving transistor under signal control of a reset signal terminal;

the light emitting control circuit is configured to electrically connect the plurality of light emitting devices to a second electrode of the driving transistor in a time-sharing manner under signal control of a plurality of light emitting control signal terminals; and a first electrode of the driving transistor is electrically connected with a power voltage terminal;

wherein the scanning signal terminal comprises a first subscanning signal terminal and a second subscanning signal terminal; and the data control circuit comprises: a first switching transistor, a second switching transistor, a third switching transistor and a first capacitor;

a first terminal of the first switching transistor is electrically connected to the data signal terminal, a control terminal of the first switching transistor is electrically connected to the first subscanning signal terminal, and a second terminal of the first switching transistor is electrically connected to the gate of the driving transistor;

a first terminal of the second switching transistor is electrically connected to the data signal terminal, a control terminal of the second switching transistor is electrically connected to the second subscanning signal terminal, and a second terminal of the second switching transistor is electrically connected to the gate of the driving transistor;

a first terminal of the third switching transistor is electrically connected to the gate of the driving transistor, a control terminal of the third switching transistor is electrically connected to the reset signal terminal, and a second terminal of the third switching transistor is directly connected to the reference voltage signal terminal; and a first terminal of the first capacitor is electrically connected to the gate of the driving transistor, and a second terminal of the first capacitor is directly connected to the reference voltage signal terminal.

2. The driving circuit according to claim 1, wherein the data control circuit comprises: a fourth switching transistor, a fifth switching transistor and a second capacitor, wherein a first terminal of the fourth switch transistor is electrically connected to the data signal terminal, a control terminal of the fourth switch transistor is electrically connected to the scanning signal terminal, and a second terminal of the fourth switch transistor is electrically connected to the gate of the driving transistor;

a first terminal of the fifth switching transistor is electrically connected to the gate of the driving transistor, a control terminal of the fifth switching transistor is electrically connected to the reset signal terminal, and a second terminal of the fifth switching transistor is electrically connected to the reference voltage signal terminal; and a first terminal of the second capacitor is electrically connected to the gate of the driving transistor, and a second terminal of the second capacitor is electrically connected to the reference voltage signal terminal.

3. The driving circuit according to claim 1, wherein the light emitting control circuit comprises a plurality of light emitting control transistors, wherein the plurality of light-emitting control transistors correspond to the plurality of light emitting devices in one-to-one manner, and the plurality of light emitting control transistors correspond to the plurality of light emitting control signal terminals in one-to-one manner; and a first terminal of the plurality of light emitting control transistors is electrically connected to a second electrode of the driving transistor, a second terminal of the plurality of light emitting control transistors is electrically connected to a corresponding light emitting device, and a control terminal of the plurality of light emitting control transistors is electrically connected to a corresponding light emitting control signal terminal.

4. A display panel, comprising a plurality of sub-pixels arranged in an array; the plurality of sub-pixels are divided into a plurality of sub-pixel groups; the plurality of sub-pixel groups are provided correspondingly in one-to-one manner with the driving circuit according to claim 1; and a sub-pixel of the plurality of sub-pixel groups is correspondingly in one-to-one manner provided with a light emitting device in the driving circuit.

5. The display panel according to claim 4, wherein the plurality of sub-pixels comprise first-color sub-pixels, second-color sub-pixels and third-color sub-pixels; and in every two adjacent sub-pixel columns, the second-color sub-pixels in one sub-pixel column are sequentially arranged, and the first-color sub-pixels and the third-color sub-pixels are alternately arranged in other sub-pixel column.

6. The display panel according to claim 4, wherein the plurality of sub-pixel group comprise at least two sub-pixels adjacent to each other in a column direction of the sub-pixels; or the plurality of sub-pixel groups comprise at least two sub-pixels adjacent to each other in a row direction of the sub-pixels.

7. The display panel according to claim 4, wherein the data control circuit comprises: a fourth switching transistor, a fifth switching transistor and a second capacitor, wherein a first terminal of the fourth switch transistor is electrically connected to the data signal terminal, a control terminal of the fourth switch transistor is electrically connected to the scanning signal terminal, and a second terminal of the fourth switch transistor is electrically connected to the gate of the driving transistor;

a first terminal of the fifth switching transistor is electrically connected to the gate of the driving transistor, a control terminal of the fifth switching transistor is electrically connected to the reset signal terminal, and a second terminal of the fifth switching transistor is electrically connected to the reference voltage signal terminal; and a first terminal of the second capacitor is electrically connected to the gate of the driving transistor, and a second terminal of the second capacitor is electrically connected to the reference voltage signal terminal.

8. The display panel according to claim 4, wherein the light emitting control circuit comprises a plurality of light emitting control transistors, wherein the plurality of light-emitting control transistors correspond to the plurality of light emitting devices in one-to-one manner, and plurality of light emitting control transistors correspond to the plurality of light emitting control signal terminals in one-to-one manner; and a first terminal of the plurality of light emitting control transistors is electrically connected to a second electrode of the driving transistor, a second terminal of the plurality of light emitting control transistors is electrically connected to a corresponding light emitting device, and a control terminal of the plurality of light emitting control transistors is electrically connected to a corresponding light emitting control signal terminal.

9. A display device, comprising the display panel according to claim 4.

10. The display device according to claim 9, wherein the data control circuit comprises: a fourth switching transistor, a fifth switching transistor and a second capacitor, wherein a first terminal of the fourth switch transistor is electrically connected to the data signal terminal, a control terminal of the fourth switch transistor is electrically connected to the scanning signal terminal, and a second terminal of the fourth switch transistor is electrically connected to the gate of the driving transistor;

a first terminal of the fifth switching transistor is electrically connected to the gate of the driving transistor, a control terminal of the fifth switching transistor is electrically connected to the reset signal terminal, and a second terminal of the fifth switching transistor is electrically connected to the reference voltage signal terminal; and a first terminal of the second capacitor is electrically connected to the gate of the driving transistor, and a second terminal of the second capacitor is electrically connected to the reference voltage signal terminal.

11. The display device according to claim 9, wherein the light emitting control circuit comprises a plurality of light emitting control transistors, wherein the plurality of light-emitting control transistors correspond to the plurality of light emitting devices in one-to-one manner, and plurality of light emitting control transistors correspond to the plurality of light emitting control signal terminals in one-to-one manner; and a first terminal of the plurality of light emitting control transistors is electrically connected to a second electrode of the driving transistor, a second terminal of the plurality of light emitting control transistors is electrically connected to a corresponding light emitting device, and a control terminal of the plurality of light emitting control transistors is electrically connected to a corresponding light emitting control signal terminal.

12. A driving method of the driving circuit according to claim 1, comprising:

in a display cycle, controlling the light emitting devices in the driving circuit to be turned on in a time-sharing manner, wherein the display cycle comprises a plurality of driving cycles; in a same display cycle, the light emitting devices driven by the light emitting control circuit to emit light are different in different driving cycles;

the driving cycles comprise:

a reset phase in which the data control circuit supplies the signal of the reference voltage signal terminal to the gate of the driving transistor under the signal control of the reset signal terminal; and a data input phase in which the data control circuit supplies the signal of the data signal terminal to the gate of the driving transistor under the signal control of the scanning signal terminal; and a light emitting phase in which the light control circuit supplies a signal of the second electrode of the driving transistor to a corresponding light emitting device under the signal control of one of the light emitting control signal terminals.

13. The driving method according to claim 12, wherein the driving circuit comprises two light emitting devices, and the display cycle comprises: a first driving cycle and a second driving cycle, wherein the first driving cycle comprises:

a reset phase in which the data control circuit supplies the signal of the reference voltage signal terminal to the gate of the driving transistor under the signal control of the reset signal terminal;

a data input phase in which the data control circuit supplies the signal of the data signal terminal to the gate of the driving transistor under the signal control of the scanning signal terminal; and a light emitting phase in which the light emitting control circuit supplies the signal of the second electrode of the driving transistor to one of the two light emitting devices under the signal control of one of the light emitting control signal terminals;

the second driving cycle comprises:

a reset phase in which the data control circuit supplies the signal of the reference voltage signal terminal to the gate of the driving transistor under the signal control of the reset signal terminal;

a data input phase in which the data control circuit supplies the signal of the data signal terminal to the gate of the driving transistor under the signal control of the scanning signal terminal; and a light emitting phase in which the light emitting control circuit supplies the signal of the second electrode of the driving transistor to other light emitting device of the two light emitting devices under the signal control of other light emitting control signal terminal.

* * * * *